US009061688B2

(12) United States Patent
Yue et al.

(10) Patent No.: US 9,061,688 B2
(45) Date of Patent: Jun. 23, 2015

(54) BOTTOM DOOR DEVICE AND HOPPER CAR HAVING THE SAME

(75) Inventors: Linghan Yue, Qiqihar (CN); Shuang Yang, Qiqihar (CN); Baichuan He, Qiqihar (CN); Lei Yu, Qiqihar (CN); Zhigang Li, Qiqihar (CN); Tianjun Zhao, Qiqihar (CN); Yong Fu, Qiqihar (CN); Shengkun Wang, Qiqihar (CN)

(73) Assignee: QIQIHAR RAILWAY ROLLING STOCK CO., LTD., Qiqihar (CN)

( * ) Notice: Subject to any disclaimer, the term of this patent is extended or adjusted under 35 U.S.C. 154(b) by 0 days.

(21) Appl. No.: 13/884,271

(22) PCT Filed: Jul. 27, 2012

(86) PCT No.: PCT/CN2012/079275

§ 371 (c)(1),
(2), (4) Date: May 9, 2013

(87) PCT Pub. No.: WO2013/056583

PCT Pub. Date: Apr. 25, 2013

(65) Prior Publication Data

US 2014/0224148 A1 Aug. 14, 2014

(30) Foreign Application Priority Data

Oct. 20, 2011 (CN) ..... 2011 1 0320400

(51) Int. Cl.
*B61D 7/00* (2006.01)
*B61D 7/22* (2006.01)
(Continued)

(52) U.S. Cl.
CPC .. *B61D 7/22* (2013.01); *B61D 7/02* (2013.01); *B61D 7/18* (2013.01)

(58) Field of Classification Search
CPC ..... B61D 7/00; B61D 7/02; B61D 7/22; B61D 7/18; B61D 7/30; B61D 7/26; B61D 7/28; B61D 7/08
USPC ..... 105/280, 281, 282.2, 247, 250, 253, 105/240
See application file for complete search history.

(56) References Cited

U.S. PATENT DOCUMENTS 3,075,477 A * 1/1963 Sinhoff ..... 105/247
3,169,491 A * 2/1965 Darlington et al. ..... 105/240
(Continued)

FOREIGN PATENT DOCUMENTS

CN 101746305 A 6/2010
CN 102431564 A 5/2012
NL 8200518 A 9/1983

*Primary Examiner* — Jason C Smith
(74) *Attorney, Agent, or Firm* — Kilpatrick Townsend & Stockton LLP

(57) ABSTRACT

The present application provides a bottom door device and a hopper car, the bottom door device includes a first bottom door and a second bottom door, the first bottom door includes a first door end plate and a first bottom door plate which are fixedly connected, the second bottom door includes a second door end plate and a second bottom door plate which are fixedly connected, and a labyrinth seal is formed between the first bottom door plate and the second bottom door plate. By using a labyrinth seal to replace the overlapping sealing in the prior art, the bottom door device and the hopper car provided by the present application can still meet the sealing requirement on the premise that the two bottom door plates can be closed without complying with any specific order, thereby optimizing the structure of the bottom door device in the prior art.

6 Claims, 5 Drawing Sheets

(51) Int. Cl.
*B61D 7/02* (2006.01)
*B61D 7/18* (2006.01)

(56) References Cited

U.S. PATENT DOCUMENTS 3,650,221 A * 3/1972 Nagy ..... 105/240
4,207,020 A * 6/1980 Schuller ..... 414/378
4,222,334 A * 9/1980 Peterson ..... 105/250
4,250,814 A * 2/1981 Stark et al. ..... 105/251
4,339,222 A * 7/1982 Knippel ..... 414/387
4,366,757 A * 1/1983 Funk ..... 105/248
4,480,954 A * 11/1984 Manstrom ..... 414/383
4,500,230 A * 2/1985 Bateson ..... 406/131
4,781,125 A * 11/1988 Friedenthal ..... 105/250
5,115,748 A * 5/1992 Westlake ..... 105/286
6,279,487 B1 * 8/2001 Gaydos et al. ..... 105/289
8,596,203 B2 * 12/2013 Forbes et al. ..... 105/248
8,640,631 B2 * 2/2014 Josephson et al. ..... 105/247
2013/0032055 A1 * 2/2013 Josephson et al. ..... 105/247
2014/0158017 A1 * 6/2014 Josephson et al. ..... 105/280
2014/0216299 A1 * 8/2014 Yue et al. ..... 105/286
2014/0224148 A1 * 8/2014 Yue et al. ..... 105/280

* cited by examiner

BOTTOM DOOR DEVICE AND HOPPER CAR HAVING THE SAME

The present application is the national phase of International Application No. PCT/CN2012/079275, titled "BOTTOM DOOR DEVICE AND HOPPER CAR", filed on Jul. 27, 2012, which claims the benefit of priority to Chinese Patent Application No. 201110320400.7 titled "BOTTOM DOOR DEVICE AND HOPPER CAR", filed with the Chinese State Intellectual Property Office on Oct. 20, 2011. The entire disclosure thereof is incorporated herein by reference.

FIELD OF THE INVENTION

The present application relates to the field of manufacturing technology of transportation vehicle, and particularly to a bottom door device and a hopper car having the same.

BACKGROUND OF THE INVENTION

The hopper car is a bottom-dump vehicle, is mainly used for transporting granular cargo and discharging the granular cargo from the bottom of the car after the vehicle arrives at the destination.

Due to the long transportation distance and the stronger vibration during the transportation, when transporting valuable and powdery granular cargo with the bottom-dump car, the sealing performance of the bottom door device is very important. A poor sealing performance may result in cargo leakage which causes economic loss, and worst of all, may result in polluting environment and threatening life safety of related person.

FIG. 1*a* is a schematic view of the structure of a bottom door device of a hopper car in the prior art with the bottom door device in a closed state, and FIG. 1*b* is an enlarged schematic view of part I in FIG. 1*a*. The bottom door device includes a first bottom door 1 and a second bottom door 2 arranged symmetrically, both of which are hinged to the hopper car body. The first bottom door 1 includes a first door end plate 11 and a first bottom door plate 12 which are fixedly connected by welding, and the first door end plate 11 is hinged to the car body at position "A". The second bottom door 2 includes a second door end plate 21 and a second bottom door plate 22 which are fixedly connected by welding, and the second door end plate 21 is hinged to the car body at position "B". The sealing of the bottom door device is realized by the overlapping between the second bottom door plate 22 and the first bottom door plate 12.

The overlapping sealing way has a strict order requirement for closing the doors; when closing the doors, the second bottom door plate must be closed firstly and then the first bottom door plate is closed; if the doors are not closed in the right order, the bottom door device will have no sealing effect. Thus, in the bottom door device using the overlapping sealing, a driving mechanism must be provided to control the two doors to be closed in the right order, and meanwhile, corresponding parts, for controlling the two doors to be closed in the right order, have to be provided in the control system of the driving mechanism, therefore the bottom door device may have a very complicated structure and a high manufacture cost.

SUMMARY OF THE INVENTION

In view of this, an object of the present application is to provide a bottom door device and a hopper car having the same, for optimizing the structure of the bottom door device in the prior art, such that the bottom door device may have a simple structure, a low manufacture cost and an improved sealing effect.

The present application provides a bottom door device including a first bottom door and a second bottom door, wherein the first bottom door includes a first door end plate and a first bottom door plate which are fixedly connected, the second bottom door includes a second door end plate and a second bottom door plate which are fixedly connected, and a labyrinth seal is formed between the first bottom door plate and the second bottom door plate.

Preferably, a first bending portion is provided at an end portion of the first bottom door plate, a second bending portion is provided at an end portion of the second bottom door plate, and a labyrinth seal is formed between the first bending portion and the second bending portion.

Preferably, an elastic member is mounted at an end portion of the second bending portion, and when the bottom door device is in a closed state, the elastic member abuts against the first bending portion.

Preferably, the elastic member is a hollow tubular elastic member.

Preferably, the bottom door device further includes a supporting member which is fixedly arranged on the second bending portion of the second door plate for fixing the elastic member on the second bending portion.

Preferably, the supporting member includes a connecting plate and a sealing plate which are arranged vertically to each other, and the connecting plate is fixedly connected to the second bending portion.

The elastic member is wrapped by a belt-shaped wear-resistant sealing strip, and both sides of the belt-shaped wear-resistant sealing strip are clamped between the connecting plate and the second bending portion, such that the elastic member wrapped by the belt-shaped wear-resistant sealing strip is located at the outside of the sealing plate of the to supporting member.

Preferably, a protruding sealing strip retaining member is arranged on the first bending portion, and the sealing strip retaining member and the wear-resistant sealing strip are arranged opposite to each other, such that the sealing strip retaining member abuts against the wear-resistant sealing strip when the bottom door device is in a closed state.

Preferably, the sealing strip retaining member includes a nut and a bolt, the bolt is mounted in a screw hole of the first bending portion, and one end of the bolt abuts against the wear-resistant sealing strip when the bottom door device is in a closed state.

Preferably, the sealing strip retaining member is made from non-metallic material.

Preferably, the present application further provides a hopper car including a car body, and the bottom door device according to any one of above technical solutions of the present application is hinged to the car body.

By using a labyrinth seal to replace the overlapping sealing in the prior art, the bottom door device and the hopper car having the same provided by the present application can still meet the sealing requirement on the premise that the two bottom door plates can be closed in any specific order, thereby optimizing the structure of the bottom door device in the prior art. In addition, since there's no specific order requirement for closing the two bottom door plates, a driving mechanism for controlling the two bottom door plates to be closed in a specific order, may be omitted, thereby simplifying the structure of the bottom door device and reducing the manufacture cost and the following maintenance cost.

Figure 1A:
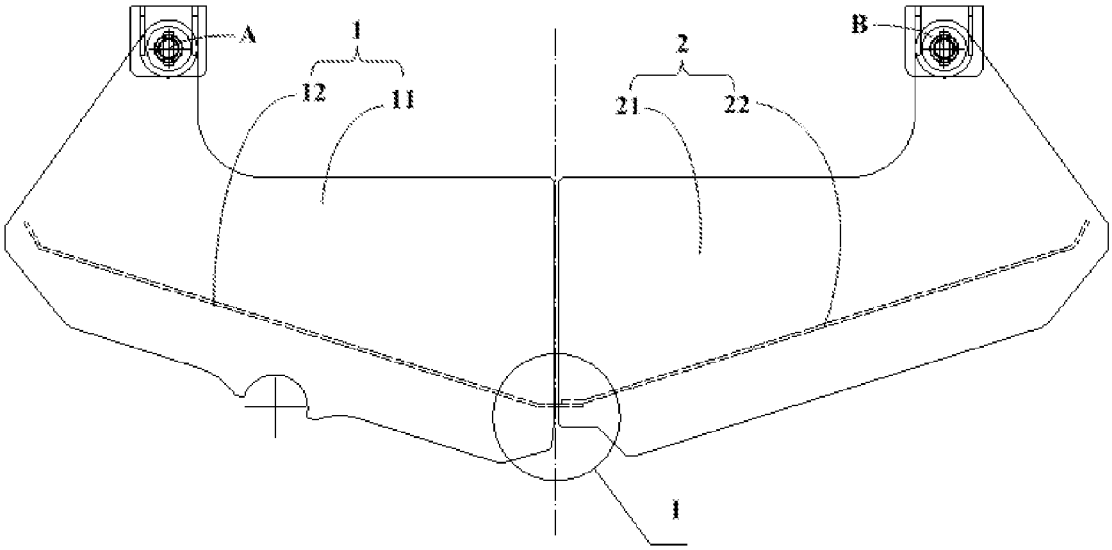
FIG. 1*a* is a schematic view of the structure of a bottom door device of a hopper car in the prior art, with the bottom door being in a closed state.
Figure 1B:
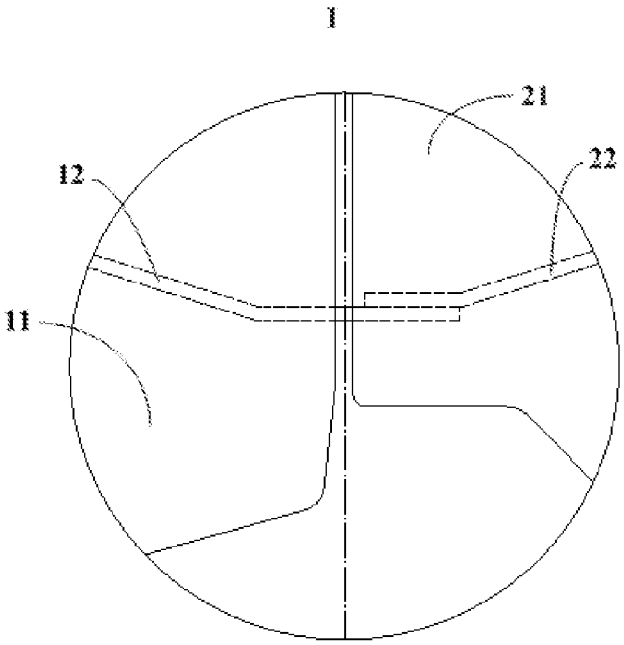
FIG. 1*b* is an enlarged schematic view of part I in FIG. 1*a;*

| Reference Numerals: | |
|---|---|
| 1, 3: first bottom door; | 2, 4: second bottom door; |
| 11, 31: first door end plate; | 12, 32: first bottom door plate; |
| 21, 41: second door end plate; | 22, 42: second bottom door plate; |
| 33: first bending portion; | 43: second bending portion; |
| 5: elastic member; | 6: wear-resistant sealing strip; |
| 7: sealing strip retaining member; | 8: supporting member; |
| 81: connecting plate; | 82: sealing plate. |

DETAILED DESCRIPTION OF THE INVENTION

For more clearly illustrating the object, technical solutions and advantages of embodiments of the present application, the technical solutions in the embodiments of the present application are described dearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the protection scope of the present application.

Figure 2A:
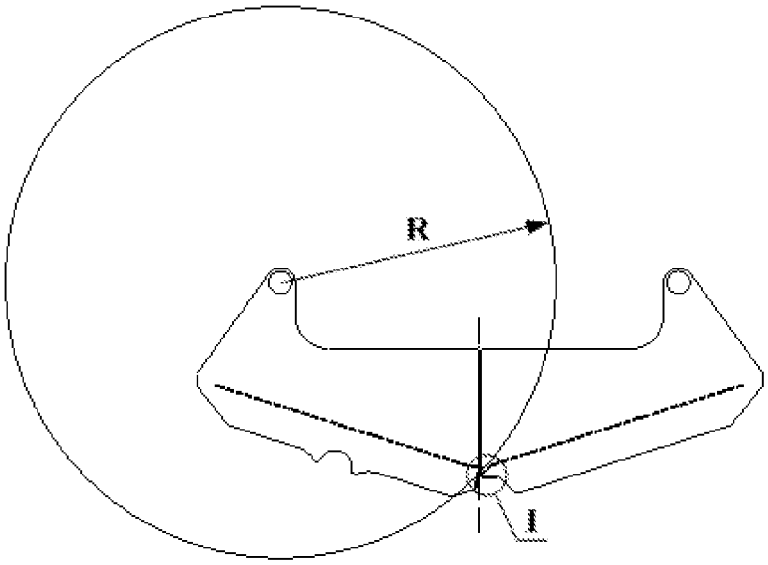
FIG. 2*a* is a schematic view of the structure of a bottom door device according to a first embodiment of the present application.
Figure 2B:
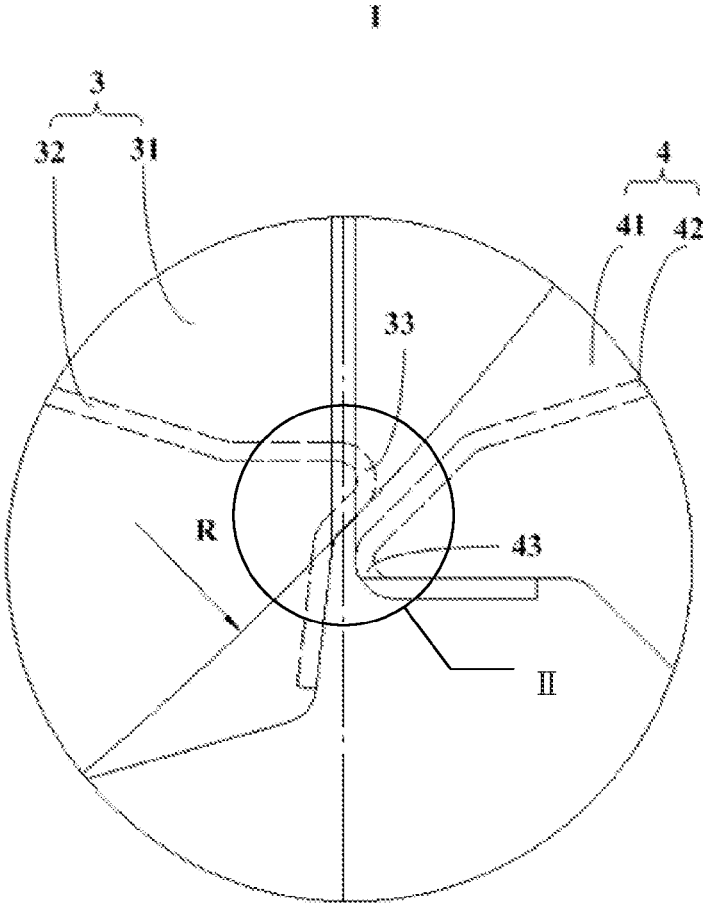
FIG. 2*b* is an enlarged schematic view of part I in FIG. 2*a;*
Figure 2C:
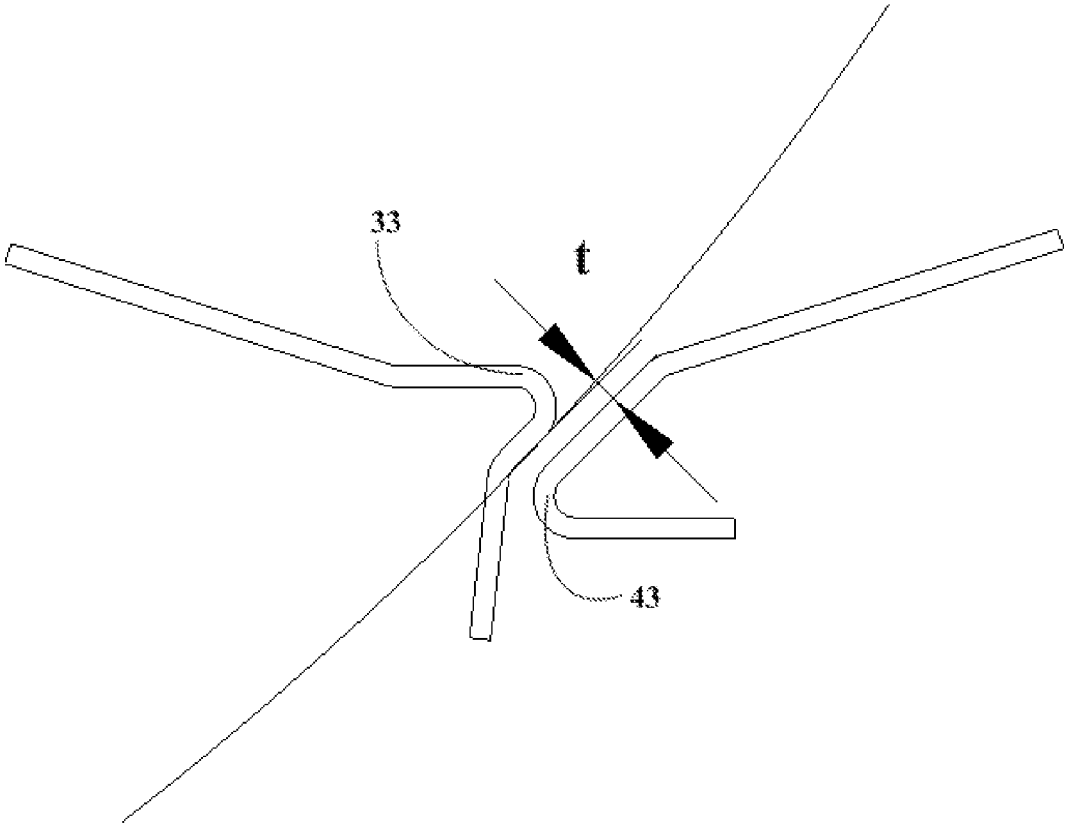
FIG. 2*c* is an enlarged schematic view of part II in FIG. 2*b;*

FIG. 2*a* is a schematic view of the structure of the bottom door device according to the first embodiment of the present application, FIG. 2*b* is an enlarged schematic view of part I in FIG. 2*a,* and FIG. 2*c* is an enlarged schematic view of part II in FIG. 2*b.* The structure of the bottom door device according to the first embodiment of the present application is described in detail hereinafter in conjunction with FIGS. 2*a,* 2*b* and 2*c.* In the present embodiment, the bottom door device includes a first bottom door 3 and a second bottom door 4, the first bottom door 3 includes a first door end plate 31 and a first bottom door plate 32 which are fixedly connected, the second bottom door 4 includes a second door end plate 41 and a second bottom door plate 42 which are fixedly connected, and a labyrinth seal is formed between the first bottom door plate 32 and the second bottom door plate 42.

Specifically, the first door end plate 31 and the first bottom door plate 32 may be fixedly connected by welding, the second door end plate 41 and the second bottom door plate 42 may be fixedly connected by welding, and it is understandable that, the above fixed connection may be realized in other ways.

There are many connection ways for realizing the labyrinth seal, as long as there is no interference between the movements of the first bottom door plate 32 and the second bottom door plate 42. The first bottom door 3 and the second bottom door 4 are respectively hinged to a car body of the hopper car, and it may be seen form FIGS. 2*a,* 2*b* and 2*c* that, the movements of the first bottom door plate 32 and the second bottom door plate 42 are rotations around each hinge point thereof respectively. No interference would happen between the movements of the first bottom door plate 32 and the second bottom door plate 42, as long as there's no overlapping portion between the rotation tracks of the first bottom door plate 32 and the second bottom door plate 42. For example, the first bottom door plate 32 and the second bottom door plate 42 can be pressed into a certain shape, or a connecting member can be placed between the first bottom door plate 32 and the second bottom door plate 42. To ensure the effect of the labyrinth seal, an interspace between movement tracks of the first bottom door plate 32 and the second bottom door plate 42 should be as small as possible. Since there's no interference between the movements of the first bottom door plate 32 and the second bottom door plate 42, the labyrinth seal may still meet the sealing requirement while the two bottom door plates can be closed in any specific order, thereby optimizing the structure of the bottom door device in the prior art. Since there's no specific order requirement for closing the two bottom door plates, a driving mechanism, for controlling the two bottom door plates to be closed in a specific order, may be omitted, thereby simplifying the structure of the bottom door device and reducing the manufacture cost and the following maintenance cost.

In a preferred implementation of the labyrinth seal, as shown in FIG. 2*c,* a first bending portion 33 is provided at an end portion of the first bottom door plate 32, a second bending portion 43 is provided at an end portion of the second bottom door plate 42, and a labyrinth seal is formed between the first bending portion 33 and the second bending portion 43. There's no overlapping portion between the rotation tracks of the first bending portion 33 and the second bending portion 43, and an interspace between the movement tracks is "t". The first bending portion 33 and the second bending portion 43 can be formed by a press plate forming, and the smaller the interspace "t" between the two movement tracks is, the better the sealing effect is. The value of "t" can be varied correspondingly according to different properties of the material loaded by the hopper car. The specific shape of the bending portion is not limited in the present application, however, it's preferred that when the bottom door device is in a closing state, the gap between the two bending portions is not completely vertical, and of course, the gap may also be vertical, but the sealing effect will be slightly weaker. It should be noted that, the shapes of the bending portions are not limited to the shape shown in FIGS. 2*b* and 2*c,* may also be other shapes, such as circular arc, circular angle, and chamfered right angle. The sealing of the bottom door is realized by the cooperating between the two bending portions, which is easy to implement and has a great sealing effect.

Figure 3:
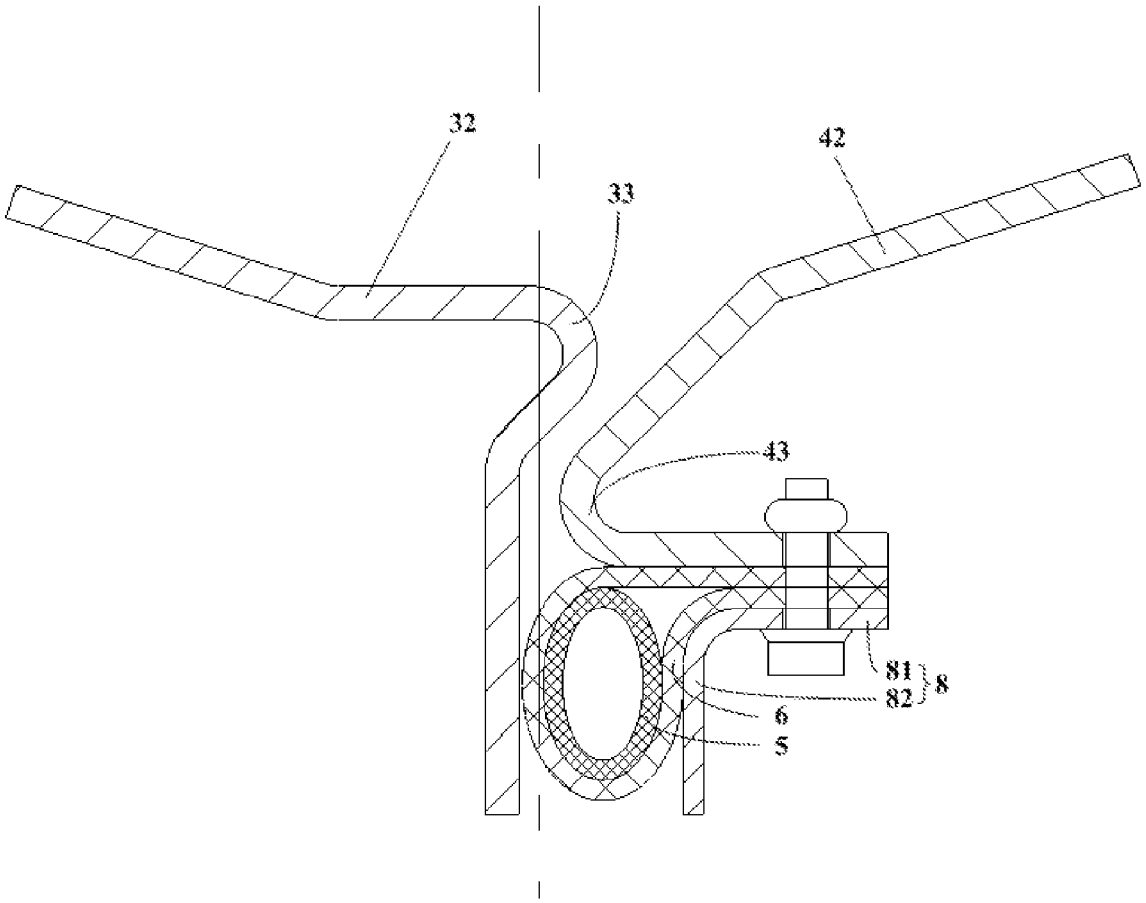
FIG. 3 is a partial schematic view of the structure of a bottom door device according to a second embodiment of the present application.

FIG. 3 is a partial schematic view of the structure of the bottom door device according to the second embodiment of the present application, and other structures of the bottom door device not shown in FIG. 3 are the same as those in FIG. 2*a,* which will not be described in detail herein. For further improving the sealing performance of the bottom door, an elastic member 5 is mounted at an end portion of the second bending portion 43, and when the bottom door device is in a closed state, the elastic member 5 abuts against the first bending portion 33.

Referring to FIG. 3, the elastic member 5 may be a hollow tubular elastic member, the material of which is rubber or other elastic material.

Further, the bottom door device further includes a supporting member 8 which is fixedly arranged on the second bending portion 43 of the second door plate 4 to fix the elastic member 5 on the second bending portion 43.

The supporting member 8 includes a connecting plate 81 and a sealing plate 82 which are arranged vertically to each other, and the connecting plate 81 is fixedly connected to the second bending portion 43. The elastic member 5 is wrapped by a belt-shaped wear-resistant sealing strip 6, and both sides of the belt-shaped wear-resistant sealing strip 6 are clamped between the connecting plate 81 and the second bending portion 43, such that the elastic member 5 wrapped by the belt-shaped wear-resistant sealing strip 6 is located at the outside of the sealing plate 82 of the supporting member 8. The connecting plate 81 and both sides of the wear-resistant sealing strip 6 are fixed on the second bending portion 43 via a bolt. It is understandable that, the connecting plate 81 and the sealing plate 82 may also be arranged to form an oblique angle, for example, the sealing plate 82 is inclined towards the first bending portion 33 to increase a compression amount so as to improve the sealing effect.

The elastic member 5 is provided at the end portion of the second bending portion 43, such that when the bottom door device is in a closed state, the elastic member 5 abuts against the first bending portion 33, thereby further improving the sealing effect of the bottom door device.

Figure 4:
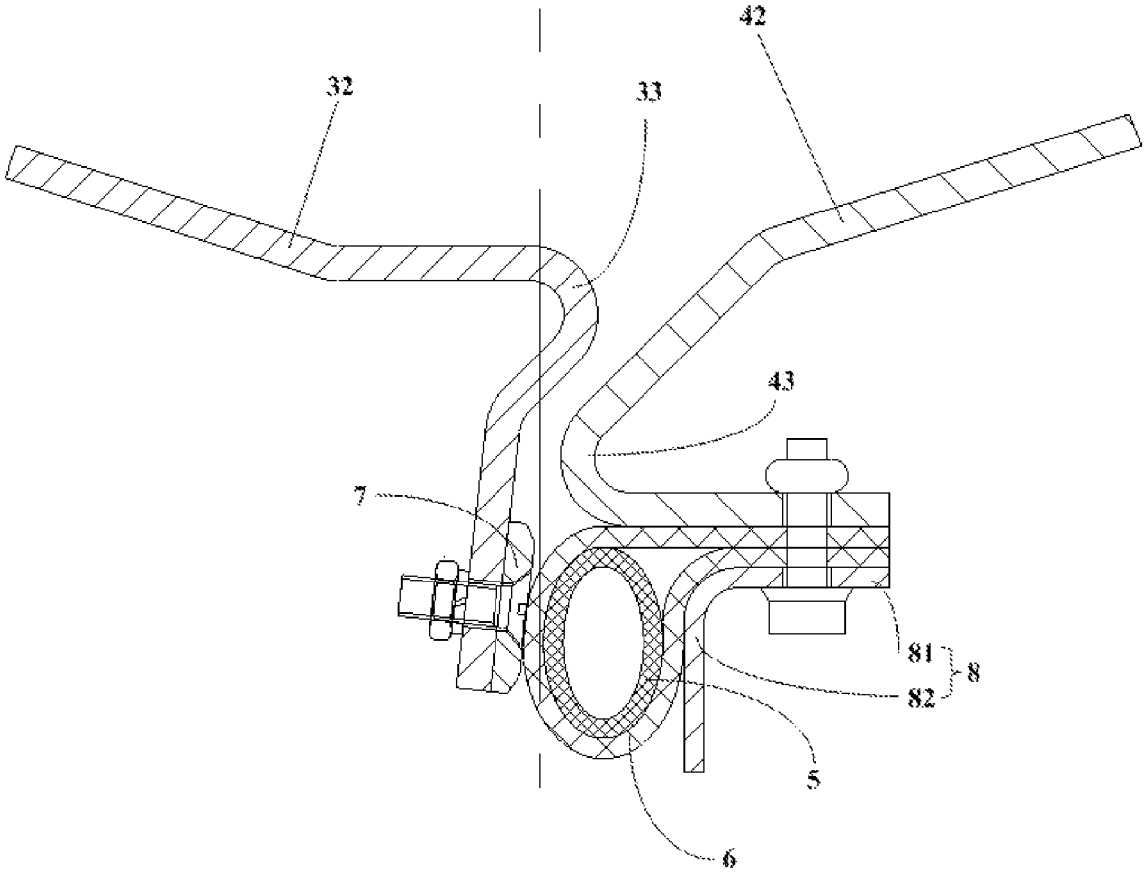
FIG. 4 is a partial schematic view of the structure of a bottom door device according to a third embodiment of the present application.

FIG. 4 is a partial schematic view of the structure of the bottom door device according to the third embodiment of the present application, and other structures of the bottom door device not shown in FIG. 4 are the same as those in FIG. 2*a*, which will not be described in detailed herein. In practical application, based on the technical solution of the second embodiment of the present application, a protruding sealing strip retaining member 7 is arranged on the first bending portion 33 so as to facilitate the adjustment of the compression amount of the wear-resistant sealing strip 6 after being assembled. The protruding sealing strip retaining member 7 and the wear-resistant sealing strip 6 are arranged opposite to each other, such that the sealing strip retaining member 7 abuts against the wear-resistant sealing strip 6 when the bottom door device is in a closed state. Specifically, the sealing strip retaining member 7 is made from a belt-shaped material having a certain thickness and is mounted in a screw hole of the first bending portion 33 via a bolt and a nut, and when the bottom door device is in a closed state, the sealing strip retaining member 7 abuts against the wear-resistant sealing strip 6. By using the sealing strip retaining member 7 having different thicknesses or by increasing or decreasing a number of gaskets between the sealing strip retaining member 7 and the first bending portion 33, the sealing strip retaining member 7 can move towards or away from the wear-resistant sealing strip 6 so as to adjust the compression amount of the wear-resistant sealing strip 6. Of course, the sealing strip retaining member 7 may also be formed in other ways, as long as it can adjust the compression amount of the wear-resistant sealing strip 6.

The sealing strip retaining member 7 may be made from non-metal material, such as rubber, nylon, or resin, so as to reduce the friction with the wear-resistant sealing strip 6 and prolong the service life of the wear-resistant sealing strip 6.

The sealing strip retaining member 7 is provided on the first bending portion 33 to adjust the compression amount of the wear-resistant sealing strip 6, which further improves the sealing effect of the bottom door device.

The embodiments of the present application further provide a hopper car including a car body, and the bottom door device according to any embodiments of the present application is hinged to the car body. Specifically, the two bottom doors of the bottom door device are respectively hinged to the car body of the hopper car.

The hopper car of the present embodiment is mounted with the bottom door device which can be closed in any specific order, thereby simplifying the structure of the hopper car, reducing the complexity of the control system of the hopper car, and reducing the product cost. Components, such as an elastic member, may be provided on the bottom door device to realize a secondary sealing so as to further improve the sealing performance.

The above description is only exemplary embodiments of the present application. It should be noted that, for the person skilled in the art, many modifications and improvements may be made without departing from the principle of the present application. The protection scope of the present application is defined by the attached claims.

The invention claimed is:

1. A bottom door device, comprising a first bottom door and a second bottom door, the first bottom door comprising a first door end plate and a first bottom door plate which are fixedly connected, the second bottom door comprising a second door end plate and a second bottom door plate which are fixedly connected, wherein a labyrinth seal is formed between the first bottom door plate and the second bottom door plate; wherein a first bending portion is provided at an end portion of the first bottom door plate, a second bending portion is provided at an end portion of the second bottom door plate, and a labyrinth seal is formed between the first bending portion and the second bending portion;

an elastic member is mounted at an end portion of the second bending portion, and when the bottom door device is in a closed state, the elastic member abuts against the first bending portion;

a supporting member which is fixedly arranged on the second bending portion of the second door plate for fixing the elastic member on the second bending portion; and the supporting member comprises a connecting plate and a sealing plate which are arranged vertically to each other, and the connecting plate is fixedly connected to the second bending portion.

2. The bottom door device according to claim 1, wherein the elastic member is a hollow tubular elastic member.

3. The bottom door device according to claim 1, wherein the elastic member is wrapped by a belt-shaped wear-resistant sealing strip, and both sides of the belt-shaped wear-resistant sealing strip are clamped between the connecting plate and the second bending portion, such that the elastic member wrapped by the belt-shaped wear-resistant sealing strip is located at the outside of the sealing plate of the supporting member.

4. The bottom door device according to claim 3, wherein a protruding sealing strip retaining member is arranged on the first bending portion, and the sealing strip retaining member and the wear-resistant sealing strip are arranged opposite to each other, such that the sealing strip retaining member abuts against the wear-resistant sealing strip when the bottom door device is in a closed state.

5. The bottom door device according to claim 4, wherein the sealing strip retaining member is made from non-metal material.

6. A hopper car, comprising a car body, wherein the bottom door device according to claim 1 is hinged to the car body.

* * * * *